US006171077B1

(12) United States Patent
Calciolari et al.

(10) Patent No.: US 6,171,077 B1
(45) Date of Patent: Jan. 9, 2001

(54) SUSPENSION SPRING SUPPORT FOR HERMETIC COMPRESSORS

(75) Inventors: Leonelo Antonio Calciolari; José Mario Silva, both of São Carlos (BR)

(73) Assignee: Tecumseh Products Company, Tecumseh, MI (US)

( * ) Notice: Under 35 U.S.C. 154(b), the term of this patent shall be extended for 0 days.

(21) Appl. No.: 09/259,576

(22) Filed: Mar. 1, 1999

(30) Foreign Application Priority Data

Mar. 11, 1998 (BR) ..... 000771

(51) Int. Cl.[7] ..... F04B 17/00; F04B 19/24
(52) U.S. Cl. ..... 417/363; 417/53; 417/902
(58) Field of Search ..... 417/363, 902, 417/53, 415

(56) References Cited

U.S. PATENT DOCUMENTS

| | | | | |
|---|---|---|---|---|
| 2,247,903 | | 1/1941 | Brace | 62/105 |
| 2,965,289 | | 12/1960 | Weibel, Jr. | 230/235 |
| 3,445,059 | | 5/1969 | Hannibal et al. | 230/235 |
| 3,849,028 | | 11/1974 | Kurita et al. | 417/363 |
| 4,566,865 | * | 1/1986 | Nishitsuji et al. | 417/363 |
| 4,808,085 | | 2/1989 | Nishitsuji | 417/363 |
| 5,322,419 | | 6/1994 | Novolan et al. | 417/363 |
| 5,342,179 | * | 8/1994 | Dreiman | 417/363 |

FOREIGN PATENT DOCUMENTS

| | | | | |
|---|---|---|---|---|
| 59-213955 | | 12/1981 | (JP) | 417/363 |
| 59-213955 | * | 12/1984 | (JP) | 417/363 |
| 5-164047 | | 6/1993 | (JP) | 417/363 |

* cited by examiner

*Primary Examiner*—Timothy S. Thorpe
*Assistant Examiner*—Michael K. Gray
(74) *Attorney, Agent, or Firm*—Baker & Daniels

(57) ABSTRACT

A hermetic compressor assembly and method of assembling a hermetic compressor. The assembly includes a housing, a compression mechanism, an electric motor in driving communication with the compression mechanism, a plurality of suspension spring supports, and a suspension spring for each. The motor and compression mechanism comprise a subassembly that is installed in the housing. The support has first and second portions and a border between the portions. The first support portion is attached to the housing. The second support portion has an arcuate opening at the border between the portions, such that the second portion can be bent inwardly at this border. The suspension spring extends between the support second portion and the subassembly. The method includes the steps of attaching the first support portion to the interior of the housing, installing the subassembly into the housing past the spring supports, bending the support between its first and second portions in a radially inward direction, attaching the spring to the second spring portion, attaching the spring to the subassembly, whereby the subassembly is at least partially supported within the housing by the support through the spring.

9 Claims, 2 Drawing Sheets

SUSPENSION SPRING SUPPORT FOR HERMETIC COMPRESSORS

The present invention relates to hermetic compressors, particularly reciprocating piston hermetic compressors, and methods for their assembly.

Reciprocating piston hermetic compressors presently known and widely utilized typically have their motor and compression mechanism subassemblies suspended or supported within their housings by a plurality of springs. Suspension springs for such compressors are attached between supports distributed about and connected to the interior of the housing and portions of the motor and compression mechanism subassembly, such as the frame thereof.

With reference to the above presently existing and utilized supports for such suspension springs, previous compressors often require the use of a spring support having two parts in order to facilitate easy and convenient assembly of the compressor.

On the other hand, there presently exist hermetic compressor units in which each suspension spring support consists of only one part, but which require additional radial space between the interior of the housing and the compressor subassembly frame in order to accommodate easy and convenient assembly of the compressor. This is because the respective supports are already bent into their configuration before being attached to the interior of the housing before installation of the motor and compression mechanism subassembly thereinto.

SUMMARY OF THE INVENTION

The suspension spring support of the present invention and the inventive method of assembling such compressors overcome the above-mentioned drawbacks. The inventive support is able to combine, under conditions of extraordinary equilibrium, the positive characteristics of both types of known supports but is not affected by their respective drawbacks.

In other words, the suspension spring support of the present invention is made as a whole, single part for each suspension spring, but does not require either additional radial space between the interior of the housing and the motor and compression mechanism subassembly, or any movement of the compressor assembly at the place and time of installation of the motor and compression mechanism subassembly.

The inventive spring support referred to, therefore, is essentially made of a single stamped part that, during its stamping is not completely bent into its specific and definitive configuration, this being done only at the time of the installation of the motor and compression mechanism subassembly into the housing, its final configuration being obtained with the use of manual or automatic tools, as the compressor assembly moves on the production line.

The present invention provides a hermetic compressor assembly including a housing, a compression mechanism, an electric motor in driving communication with the compression mechanism, the motor and compression mechanism comprising a subassembly installed in said housing, and a plurality of spring supports of single-piece construction and having first and second portions and a border therebetween. The first portion is attached to said housing and the second portion has an arcuate opening at the border, such that the second portion can be bent inwardly at the border. A suspension spring is attached to each spring support and extends between the respective support second portion and the subassembly and is attached to the subassembly.

The present invention also provides a method for assembling a hermetic compressor and has the steps of: providing a housing, a compression mechanism and electric motor subassembly, a plurality of spring supports having first and second portions, and a plurality of suspension springs; attaching the first portion of each support to the housing; installing the subassembly into the housing past the spring supports; then bending the supports between their first and second portions in a radially inward direction; attaching the springs to the respective second support portions; and then attaching the springs to the subassembly. The subassembly is thus supported within the housing by the supports through the springs.

BRIEF DESCRIPTION OF THE DRAWINGS

The above-mentioned and other features and objects of this invention, and the manner of attaining them, will become more apparent and the invention itself will be better understood by reference to the following description of the embodiments of the invention taken in conjunction with the accompanying drawings, wherein.

DETAILED DESCRIPTION OF THE INVENTION

Figure 1:
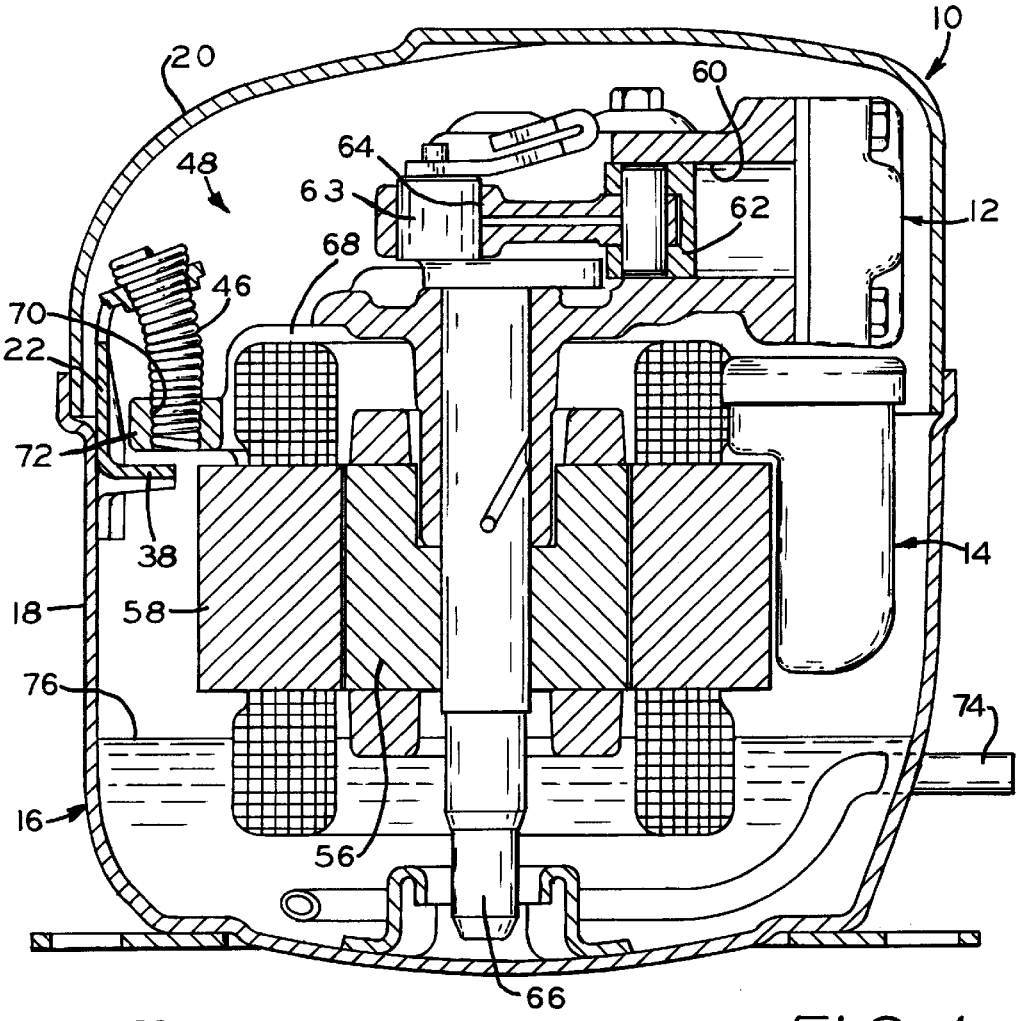
FIG. 1 is a sectional side view of a hermetic compressor embodying the present invention.
Figure 2:
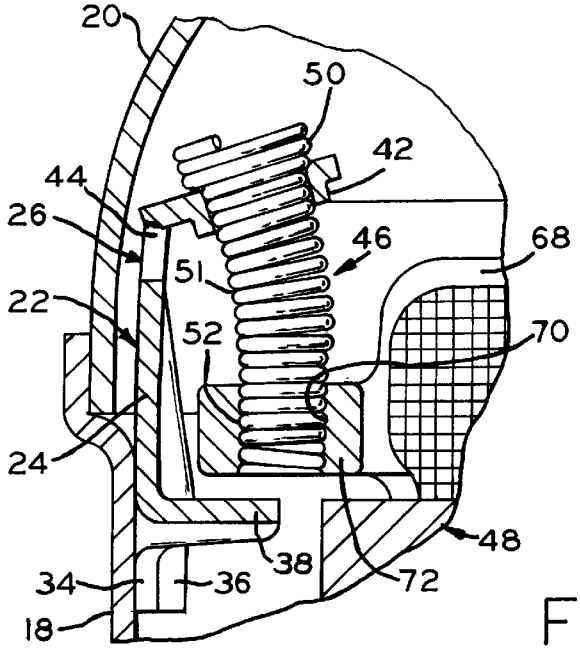
FIG. 2 is an enlarged, fragmentary sectional side view of the present invention shown in FIG. 1.

The hermetic compressor assembly described herein is commonly use in refrigeration systems. Referring first to FIGS. 1 and 2, hermetic compressor assembly 10 includes compression mechanism 12, which in the depicted embodiment is a reciprocating piston type, electric motor 14, housing 16, suspension spring support 22, and suspension spring 46. Compression mechanism 12 includes cylinder 60, piston 62, and connecting rod 64. Electric motor 14 includes rotor 56, stator 58, crankshaft 66 and frame 68. Frame 68 has tapped holes 70 in frame extension 72 for threadedly receiving a plurality of springs 46 as discussed further hereinbelow. Compression mechanism 12 and motor 14 in combination form subassembly 48. Housing 16 comprises lower portion 18 and cover 20, each of which may be made in steel. Electrical power supplied to motor 14 through stator 58 drives the rotation of rotor 56 and crankshaft 66 coupled to rotor 56. Eccentric portion 63 of crankshaft 66 drives piston 62 through connecting rod 64. Suction tube 74 passes through lower housing portion 18, delivering refrigerant into compressor assembly 10. The refrigerant flows into cylinder 60 and is compressed by piston 62. The high pressure refrigerant then exits the compressor assembly through a discharge tube (not shown). Oil 76 for lubrication of compressor assembly 10 is disposed in lower housing portion 18.

A plurality of suspension spring supports 22, at least three, are attached to lower housing portion 18 by any suitable means, such as means of resistance welding and are distributed about the cylindrical interior surface of lower housing portion 18 approximately equal distance from one another. Spring 46 extends between support 22 and tapped hole 70 in frame extension 72 of subassembly 48. Intermediary tongue 38 of support 22 provides a stop for frame extension 72 to protect the tip of crankshaft 66 from contacting lower housing portion 18.

Figure 3A:
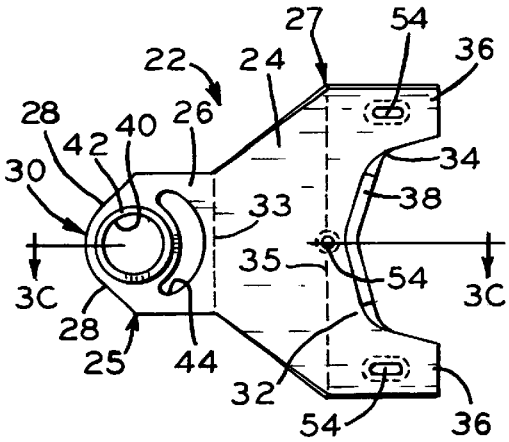
FIG. 3A is a frontal view of the suspension spring support shown as obtained by its final stamping operation.
Figure 3B:
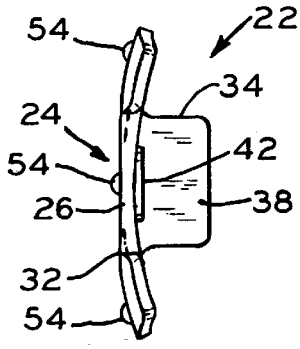
FIG. 3B is a profile view of the suspension spring support shown in FIG. 3A.
Figure 3C:
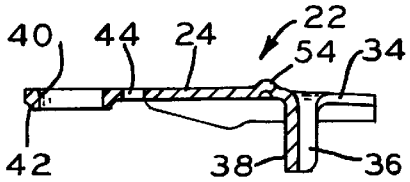
FIG. 3C is a longitudinal central section view, along 3C—3C in FIG. 3A.

As shown in FIGS. 3A–3C, the suspension spring support 22 consists of a single unit, entirely stamped from sheet steel, with a surface slightly arched in transverse direction. Support 22 contains first portion 25 and second portion 27. First portion 25 includes narrow section 26. Second portion 27 includes large middle section 24 and lower section 32. Middle section 24 is substantially of trapezoidal shape, and extending from its smaller base (the location of which is indicating by ghosted line 33 in FIGS. 3A and 4) is substantially planar, rectangular and narrow section 26 of first portion 25 which has a free edge made up of two symmetrically inclined and convergent portions 28 that are interconnected by arched end portion 30. Middle section 24, from its wider base (the location of which is indicated by ghosted line 35 in FIGS. 3A and 4), extends over large lower section 32. Lower section 32 is basically rectangular in shape, but with large polygonal and symmetrical cuts 45 in edge 34 which form two lateral and trapezoidal end points 36, as well as a wide intermediary tongue 38, slightly trapezoidal, with two inclined planes and orthogonally bent forward. End points 36 include projecting contact portions 54 for resistant welding support 22 to the interior surface of lower housing portion 18.

Furthermore, narrow section 26 of first portion 25 has centrally and longitudinally located large circular orifice 40 with salient ring border 42 and large,arcuate transverse aperture 44 in the shape of a quarter moon directly adjacent orifice 40. Aperture 44 is placed very near ghosted line 33 between narrow section 26 of first portion 25 and middle section 24 of second portion 27.

Figure 4:
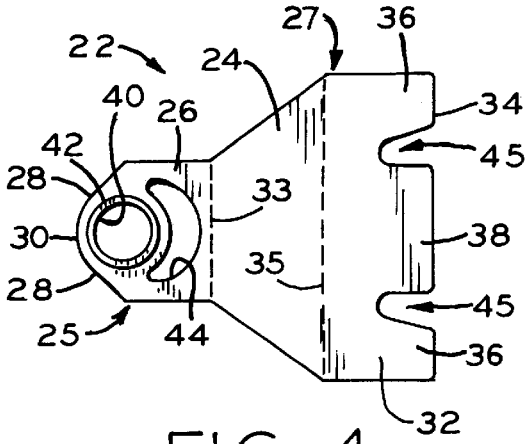
FIG. 4 is a frontal view of the suspension spring support blank shown prior to its final stamping operation.

The single and whole support part for the suspension spring, presented here, is obtained from the final stamping operation as described above and illustrated in FIGS. 3A through 3C. FIG. 4 shows support 22 as a blank prior to its final stamping operation.

Figure 5:
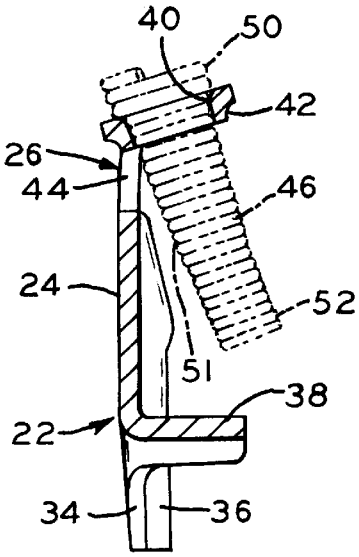
FIG. 5 repeats the section view in FIG. 3C, but with the spring support in its final definitive bent configuration as obtained during the assembling of the compressor assembly with its suspension spring.
Figure 6:
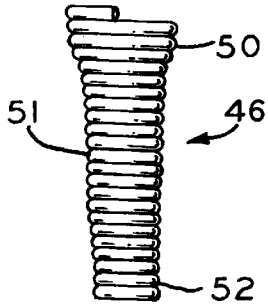
FIG. 6 is a side view of the suspension spring.

Spring 46, as shown in FIG. 6, has three portions 50, 51, 52. First portion 50 and third portion 52 include a plurality of coils having substantially uniform diameters. The diameter of first portion 50 is greater than the diameter of third portion 52. Second portion 51 includes a plurality of coils of varying diameters such that portion 51 is generally tapered between the diameter of first portion 50 and the diameter of third portion 52. The diameter of orifice 40 is smaller than the diameter of first portion 50 and greater than the diameter of third portion 52 and the largest diameter of portion 51. Second portion 51 and third portion 52 of spring 46 are disposed through orifice 40 until first portion 50 abuts with the perimeter of orifice 40 as shown in FIG. 5. Third portion 52 of spring 46 in FIG. 2 is threadedly received in tapped hole 70 provided in frame extension 72 of subassembly 48.

Assembly of the compressor on the production line includes the following steps. Lower housing portion 18 with a plurality of unbent supports 22 as shown in FIGS. 3A–3C attached thereto is received by an assembler. The assembler inserts compression mechanism and motor subassembly 48 into lower housing portion 18, aligning frame extensions 72 with supports 22. Next the assembler bends supports 22 into their final configuration, as shown in FIG. 5, with a manual or automatic tool. The definitive, final configuration is imparted to support 22 by bending narrow section 26 forward, which is made possible and facilitated by the presence of the quarter-moon shaped transverse aperture 44, giving section 26 a slightly inclined and ascending orientation. A spring 46 is disposed through each orifice 40 of supports 22 and threadedly attached to tapped holes 70 provided in frame extensions 72. Subassembly 48 is thus suspended from supports 22 through springs 46. Cover 20 is then attached to lower housing portion 18. Notably, suspension spring 46 may be positioned in the large circular orifice 40 either before or after the bending operation.

While this invention has been described as having different embodiments, the present invention can be further modified within the spirit of the scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A hermetic compressor assembly comprising:

a housing;

a compression mechanism;

an electric motor in driving communication with said compression mechanism, said motor and said compression mechanism comprising a subassembly, said subassembly installed in said housing;

a plurality of spring supports of single-piece construction, each spring support of said plurality of spring supports having first and second portions, said second portion attached to said housing, said first portion having an arcuate aperture therein, a section of said first portion containing said arcuate aperture being bent inwardly of said housing; and a suspension spring attached to each said spring support extending between the respective said first portion and said subassembly and being attached to said subassembly.

2. The hermetic compressor assembly of claim 1, wherein said each spring support has a surface which is arched in a transverse direction.

3. The hermetic compressor assembly of claim 1, wherein said second portion of said support includes a trapezoidal section and a rectangular section, said trapezoidal section includes a smaller base bordering said first portion and a wider base bordering said rectangular section.

4. The hermetic compressor assembly of claim 3, wherein said rectangular section of said second portion of said support includes an edge opposite said trapezoidal section, said edge having a pair of wide polygonal cuts defining two lateral and trapezoidal end points and an orthogonally bent forward intermediary tongue.

5. The hermetic compressor assembly of claim 1, wherein said second portion includes a centrally and longitudinally located large circular orifice for engaging each said spring, and said arcuate aperture is between said orifice and said border.

6. The hermetic compressor assembly of claim 1, wherein said second portion of said support includes a pair of projecting contact portions.

7. The hermetic compressor assembly of claim 1, wherein said compression mechanism is a reciprocating piston compressor.

8. A method for assembling a hermetic compressor, comprising the steps of:

providing a housing, a compression mechanism and electric motor subassembly, a plurality of spring supports having first and second portions, and a plurality of suspension springs;

attaching the second portion of each spring support of said plurality of spring supports to the housing;

installing the subassembly into the housing past said each spring support;

then bending the first portion of the supports in a radially inward direction relative to the housing;

attaching the springs to the respective first support portions; and then attaching the springs to the subassembly;

whereby the subassembly is supported within the housing by the supports through the springs.

9. The method of claim 8, wherein said step of attaching the springs to the first support portions precedes said bending step.

* * * * *